US012252893B1

(12) United States Patent
Eisenberg

(10) Patent No.: US 12,252,893 B1
(45) Date of Patent: Mar. 18, 2025

(54) GRAVE FOOTSTONE DRAWER

(71) Applicant: Deborah Eisenberg, Astoria, NY (US)

(72) Inventor: Deborah Eisenberg, Astoria, NY (US)

( * ) Notice: Subject to any disclaimer, the term of this patent is extended or adjusted under 35 U.S.C. 154(b) by 200 days.

(21) Appl. No.: 17/982,317

(22) Filed: Nov. 7, 2022

(51) Int. Cl.
*E04B 1/00* (2006.01)
*E04H 13/00* (2006.01)

(52) U.S. Cl.
CPC ..... *E04H 13/003* (2013.01); *E04H 13/001* (2013.01)

(58) Field of Classification Search
CPC ..... E04H 13/003; E04H 13/001
See application file for complete search history.

(56) References Cited

U.S. PATENT DOCUMENTS 291,106 A * 1/1884 Strong ..... E04H 13/003 40/124.5
669,412 A * 3/1901 Harriman ..... E04H 13/003 40/797
811,432 A * 1/1906 Peake ..... E04H 13/003 40/124.5
868,810 A * 10/1907 Reese et al. ..... E04H 13/003 52/103
1,830,629 A * 11/1931 Tulinski ..... E04H 13/003 27/1
4,324,026 A * 4/1982 Craft ..... A61G 17/08 27/1
D275,916 S * 10/1984 Brandel ..... D6/661
4,631,859 A 12/1986 Letter et al.
4,790,088 A * 12/1988 Morvant ..... G09F 19/22 40/124.5
5,127,718 A * 7/1992 Paine ..... A47F 3/001 312/296
5,687,515 A * 11/1997 Rodrigues ..... E04H 13/003 52/103
5,704,103 A * 1/1998 Crowley ..... E04H 13/003 40/124.5
5,732,515 A 3/1998 Rodrigues et al.
6,050,660 A * 4/2000 Gurley ..... B25H 5/00 312/249.11
6,088,955 A * 7/2000 Nelson, Jr. ..... E04H 13/003 248/128
D450,968 S * 11/2001 Winter ..... D6/560
6,463,703 B1 * 10/2002 Mattis ..... E04H 13/003 52/103
7,089,495 B2 * 8/2006 Barrows ..... E04H 13/003 369/69

(Continued)

*Primary Examiner* — Basil S Katcheves
(74) *Attorney, Agent, or Firm* — Cramer Patent & Design, PLLC.; Aaron R. Cramer

(57) ABSTRACT

The footstone drawer may comprise a footstone and a drawer. The footstone may be a marker that may be placed at the foot of a grave. The drawer may slide into a drawer aperture located in the footstone. The drawer may be operable to hold mementos. As non-limiting examples, the mementos may comprise decorative stones, shells, coins, photographs, flowers, religious medals, toys, and handwritten notes. Some cemeteries may restrict the placement of the mementos on the graves because the mementos may be considered unsightly and may pose a risk when mowing if the mementos fall to the ground. The footstone drawer may hold the mementos even with such restrictions since the footstone drawer stores the mementos within the footstone where the mementos out of sight and cannot fall to the ground.

1 Claim, 6 Drawing Sheets

(56) References Cited

U.S. PATENT DOCUMENTS

| | | | | |
|---|---|---|---|---|
| 7,316,054 | B2 * | 1/2008 | Acton | A61G 17/036 312/334.44 |
| D565,272 | S | 3/2008 | Markas | |
| D608,975 | S | 1/2010 | Markas | |
| 7,665,881 | B2 * | 2/2010 | Elam | E04H 13/003 362/183 |
| 7,964,149 | B1 | 6/2011 | Takvoryan | |
| 8,196,275 | B2 * | 6/2012 | Wessel | A61G 17/0405 40/124.5 |
| D664,324 | S | 7/2012 | Finley | |
| 8,215,067 | B2 | 7/2012 | Segura | |
| 8,418,344 | B1 * | 4/2013 | Letney | A47G 33/02 428/3 |
| 8,615,855 | B2 | 12/2013 | Montgomery | |
| D721,864 | S * | 1/2015 | Adler | D99/17 |
| D721,865 | S * | 1/2015 | Adler | D99/17 |
| 9,464,455 | B2 | 10/2016 | Montgomery | |
| D812,932 | S * | 3/2018 | Fraser | D6/657 |
| 10,233,663 | B1 * | 3/2019 | Grupp | E04H 13/003 |
| D863,258 | S * | 10/2019 | Song | D10/49 |
| D879,403 | S * | 3/2020 | Teague | D99/17 |
| D939,803 | S * | 12/2021 | Madison | D99/25 |

* cited by examiner

GRAVE FOOTSTONE DRAWER

RELATED APPLICATIONS

Non-applicable.

FIELD OF THE INVENTION

The presently disclosed subject matter is directed to a grave footstone and more specifically to a grave footstone having a drawer.

BACKGROUND OF THE INVENTION

Visiting a gravesite is a somber experience. Frequently when visiting, a loved one will desire to leave a memento of significance or perhaps something ephemeral like a card or flowers. While this practice is widely known and generally excepted—some cemeteries do not permit such items to be left at a gravesite. This can prove distressing and problematic to those who wish to express their grief in a tangible manner. Accordingly, there exists a need for a means by which a visitor to a gravesite can leave a memento or similar expression of love and loss which stays on site but does not violate any rule regarding the same. The development of the gravesite footstone drawer fulfills this need in an effective manner not disclosed in the prior art.

SUMMARY OF THE INVENTION

The present invention provides for a footstone drawer which has footstone having a base, a tablet, and a marker, the footstone is adapted to be placed at a foot of a grave and a drawer having a drawer bottom, a drawer left side, a drawer right side, a drawer front side, and a drawer rear side, the drawer slides into a drawer aperture located in the footstone.

The footstone may include an above-ground marker that is placed at the foot of the grave, opposite a headstone. The base may include an inset surrounding the drawer aperture that is an enlargement of the drawer aperture that is shallower than the drawer aperture such that the drawer front side fits flush with a side of the base when the drawer is closed. The tablet may rest upon the base and is an ornamental and informative portion of the footstone. The footstone may be adapted to mark the foot of the grave and serves as a boundary marker for a grave plot and provides a plurality of information about an interred decedent. One or more faces of the tablet may include an indicia.

The indicia may convey a name or a plurality of initials of the interred decedent, a date of birth of the interred decedent, a date of death of the interred decedent, a record of military service of the interred decedent, a likeness of the interred decedent, one or more religious emblems of the interred decedent, or any combination thereof. The base may include a rectangular footprint and the tablet includes a rectangular footprint that is smaller than the base footprint. The top of the tablet may have a decorative shape.

The decorative shape may be selected from the group consisting of an arched shape, a gabled shape, a shape sloped at one or more oblique angles, an irregularly shaped, or a flat shape. The footstone may be made of a material selected from the group consisting of metal, stone, granite, marble, limestone, sandstone, concrete, or bronze. The drawer may hold a plurality of mementos that are out of sight and cannot fall to a ground surface. The drawer may be an open-top hollow container for storing the mementos.

The mementos may be selected from the group consisting of decorative one or more stones, one or more shells, one or more coins, one or more photographs, one or more flowers, one or more religious medals, one or more toys, one or more handwritten notes, or any combination thereof. The drawer aperture may be a cavity in the base into which the drawer is inserted. The drawer bottom may include one or more drainage apertures to drain a plurality of rainwater and melted snow that enters the drawer. A pull handle may be disposed on a middle front portion of the drawer that is adapted to be grasped by a user in order to open the drawer. A lock may be disposed on a front portion of the drawer above the handle to prevent the drawer from being opened unless the lock is unlocked. The drawer may be made of composite resin. The drawer may be made of a material selected from the group consisting of metal, stone, granite, marble, limestone, sandstone, concrete, or bronze.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
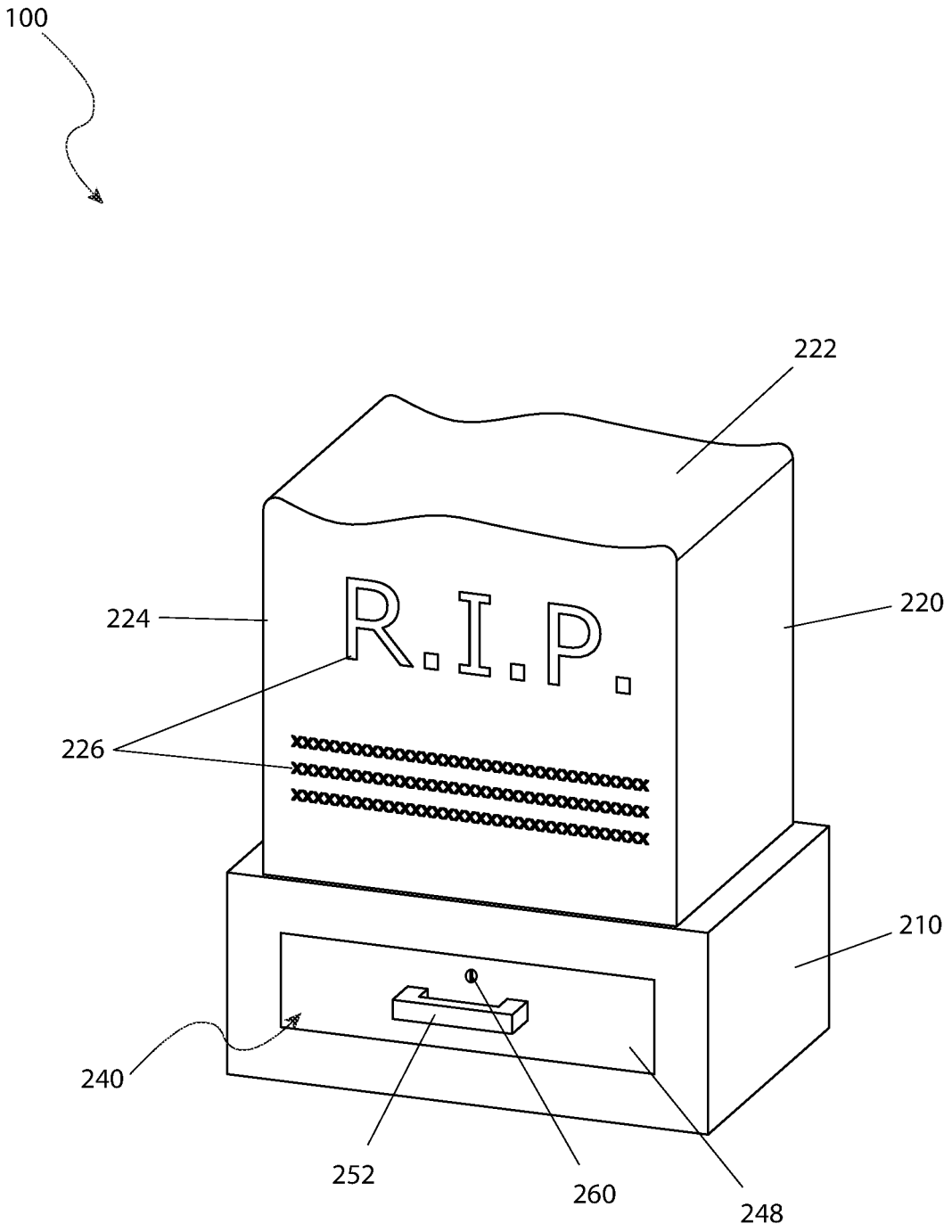
FIG. 1 is an isometric view of a footstone drawer, according to an embodiment of the present invention, illustrating a drawer closed.
Figure 2:
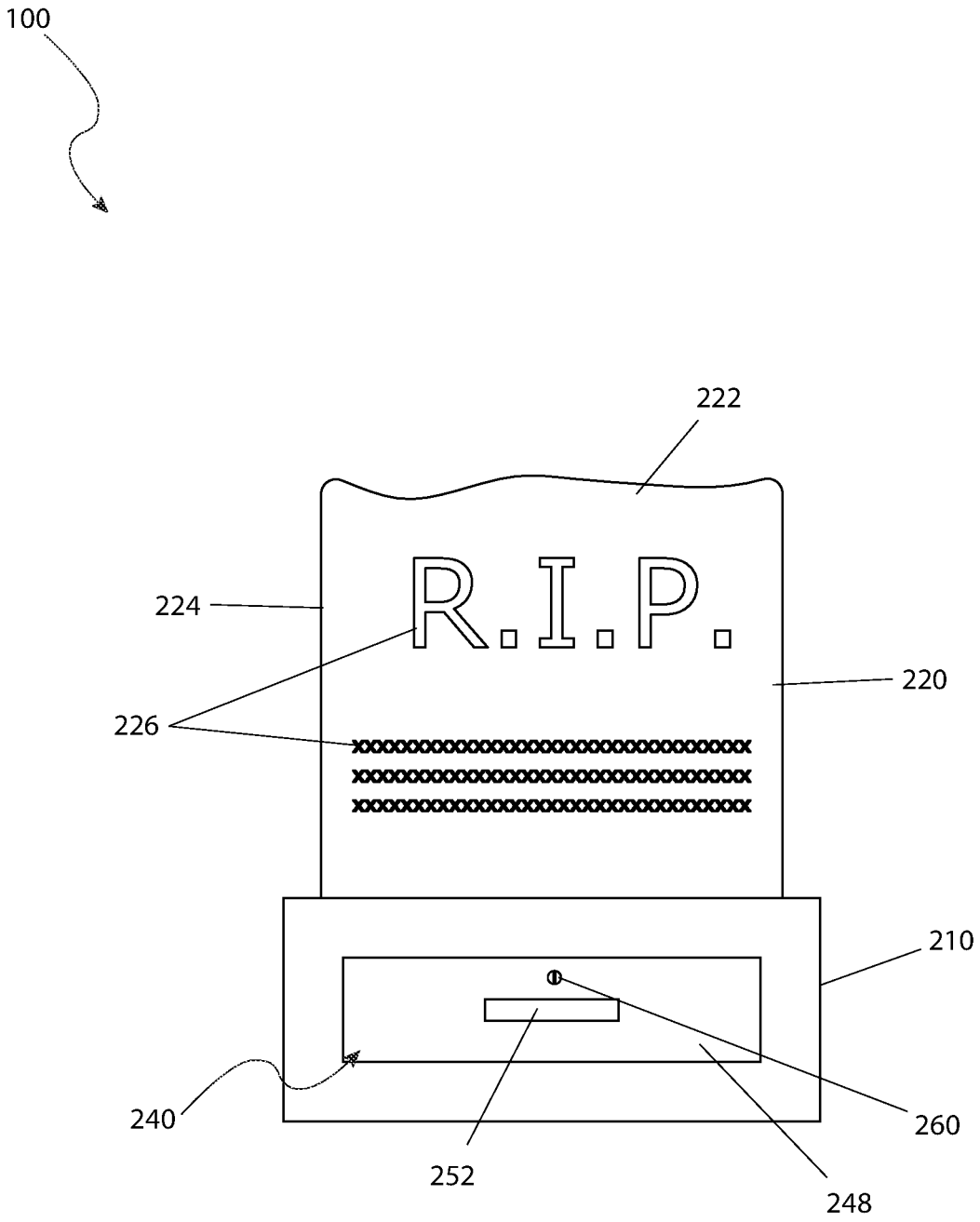
FIG. 2 is a front view of a footstone drawer, according to an embodiment of the present invention.
Figure 3:
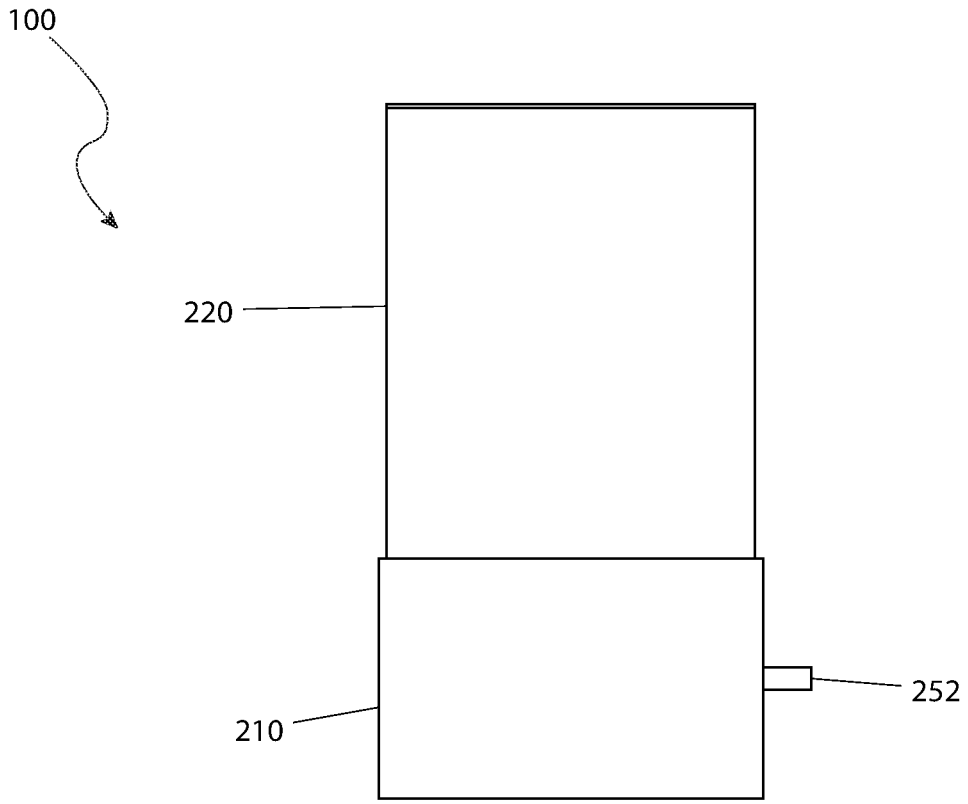
FIG. 3 is a side view of a footstone drawer, according to an embodiment of the present invention.
Figure 4:
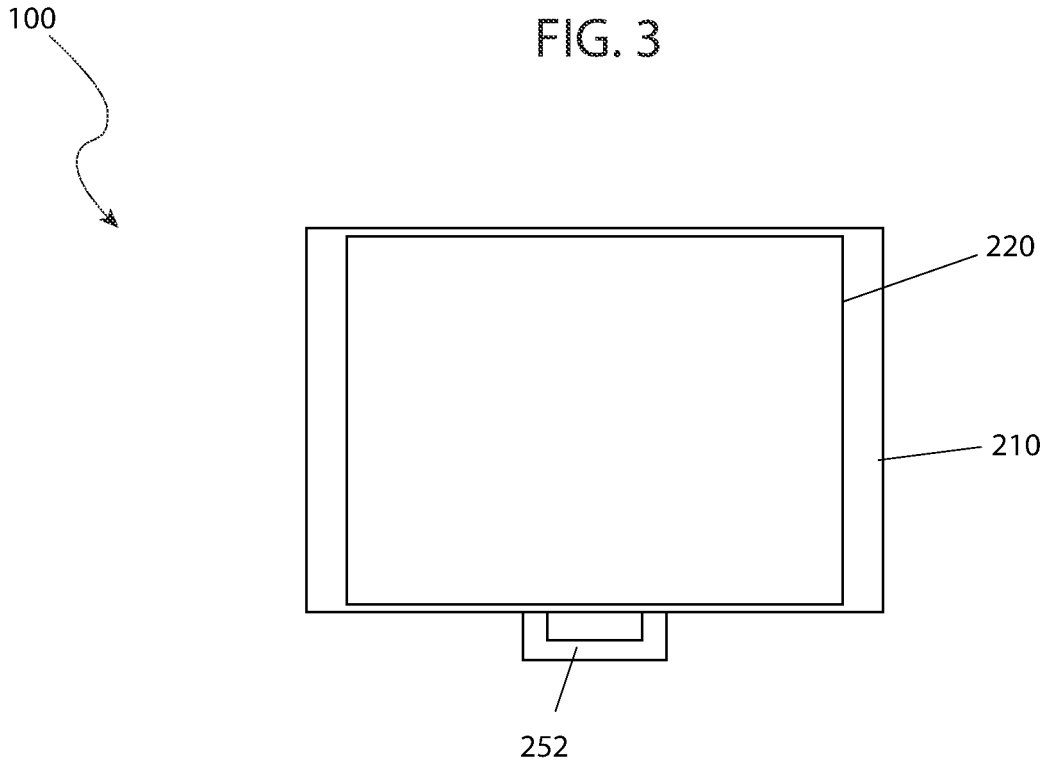
FIG. 4 is a top view of a footstone drawer, according to an embodiment of the present invention.
Figure 5:
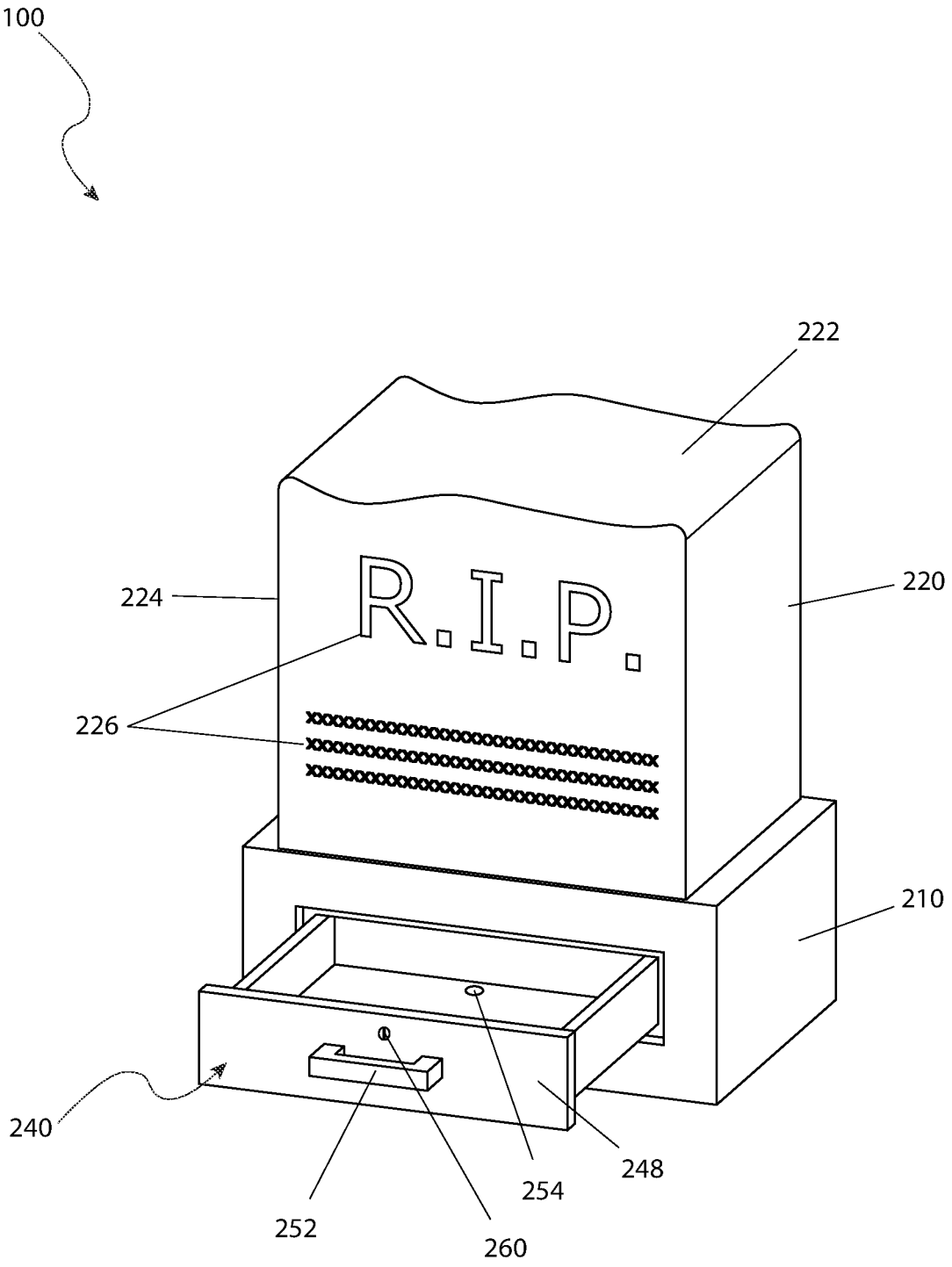
FIG. 5 is an isometric view of a footstone drawer, according to an embodiment of the present invention, illustrating the drawer open.
Figure 6:
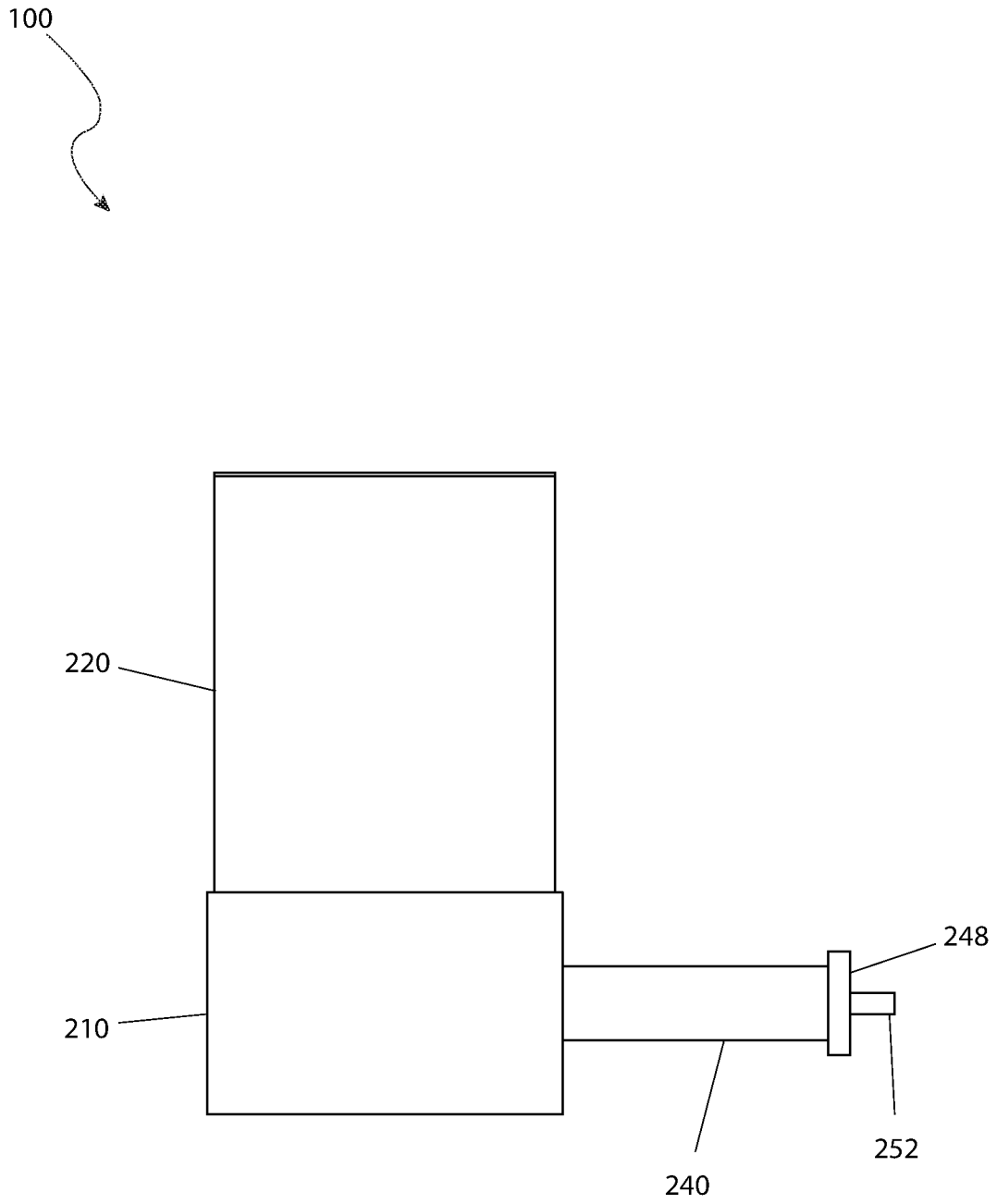
FIG. 6 is a side view of a footstone drawer, according to an embodiment of the present invention, illustrating the drawer open.
Figure 7:
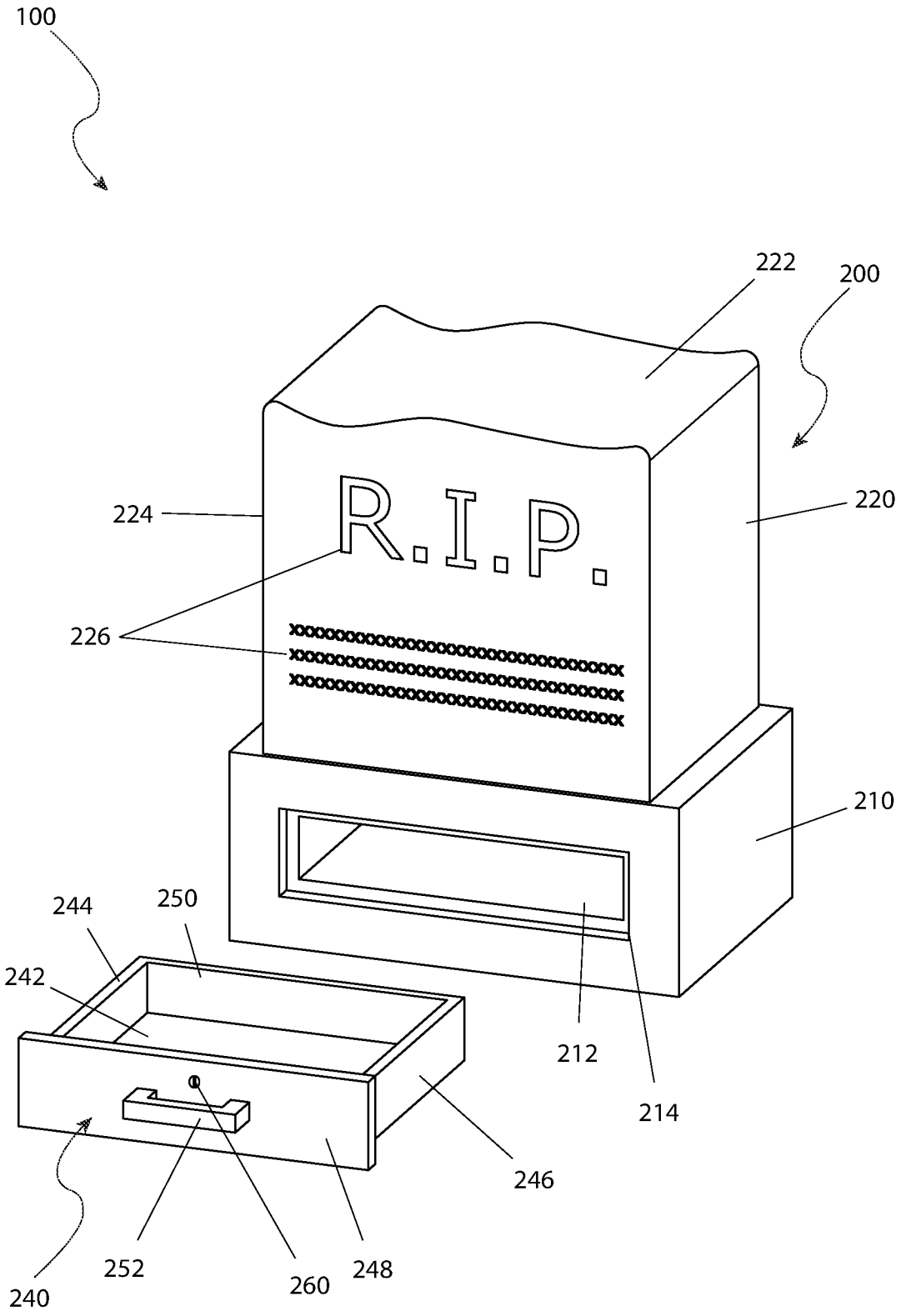
FIG. 7 is an exploded view of a footstone drawer, according to an embodiment of the present invention.

100 footstone drawer
200 footstone
210 base
212 drawer aperture
214 inset
220 tablet
222 top
224 face
226 indicia
240 drawer
242 drawer bottom
244 drawer left side
246 drawer right side
248 drawer front side
250 drawer rear side
252 pull handle
254 drainage aperture
260 lock

DESCRIPTION OF THE INVENTION

The present invention is directed to a footstone drawer (herein described as the "invention") 100. The invention 100 may comprise a footstone 200 and a drawer 240. The footstone 200 may be a marker that may be placed at the foot of a grave. The drawer 240 may slide into a drawer aperture 212 located in the footstone 200. The drawer 240 may be operable to hold mementos. As non-limiting examples, the mementos may comprise decorative stones, shells, coins, photographs, flowers, religious medals, toys, and handwritten notes. Some cemeteries may restrict the placement of the mementos on the graves because the mementos may be considered unsightly and may pose a risk when mowing if they fall to the ground. The invention 100 may hold the mementos even with such restrictions since the invention 100 stores the mementos within the footstone 200 where the mementos out of sight and cannot fall to the ground.

The footstone 200 may be an above-ground marker that may be placed at the foot of the grave, opposite a headstone. The footstone 200 may mark the foot of the grave, may serve as a boundary marker for the grave plot, may provide information about the interred decedent, or any combination thereof.

The footstone 200 may comprise a base 210 and a tablet 220. The base 210 may form the bottom of the footstone 200 and may contact the ground. The base 210 may comprise the drawer aperture 212 which may be accessible on one (1) side of the base 210. The drawer aperture 212 may be a cavity in the base 210 into which the drawer 240 may be inserted. In some embodiments, the base 210 may comprise an inset 214 surrounding the drawer aperture 212. The inset 214 may be an enlargement of the drawer aperture 212 that may be shallower than the drawer aperture 212 such that a drawer front side 248 may fit flush with the side of the base 210 when the drawer 240 is closed.

The tablet 220 may rest upon the base 210 and may be an ornamental and informative portion of the footstone 200. One (1) or more faces 224 of the tablet 220 may comprise indicia 226. The indicia 226 may be one (1) or more textual and/or graphical inscriptions. As non-limiting examples, the indicia 226 may convey the name or initials of the interred decedent, the date of birth, the date of death, a record of military service, a likeness of the interred decedent, one (1) or more religious emblems, or any combination thereof.

In a preferred embodiment, the base 210 may comprise a rectangular footprint and the tablet 220 may comprise a rectangular footprint that is smaller than the base footprint. However, neither the base 210 nor the tablet 220 are required to have a rectangular footprint.

In some embodiments, the top 222 of the tablet 220 may have a decorative shape to add to the visual appeal of the footstone 200. As non-limiting examples, the top 222 of the tablet 220 may be arched, gabled, sloped at one (1) or more oblique angles, irregularly shaped, or flat.

The drawer 240 may be an open-top hollow container for storing the mementos. The drawer 240 may comprise a drawer bottom 242, a drawer left side 244, a drawer right side 246, the drawer front side 248, and a drawer rear side 250. The drawer front side 248 may be larger than the drawer rear side 250. The front edges of the drawer left side 244, the drawer right side 246 and the drawer bottom 242 may be coupled to the rear face of the drawer front side 248. The left edge of the drawer rear side 250 may be coupled to the rear edge of the drawer left side 244. The right edge of the drawer rear side 250 may be coupled to the rear edge of the drawer right side 246. The bottom edge of the drawer rear side 250 may be coupled to the rear edge of the drawer bottom 242. The bottom edge of the drawer left side 244 may be coupled to the left edge of the drawer bottom 242. The bottom edge of the drawer right side 246 may be coupled to the right edge of the drawer bottom 242. In some embodiments, the drawer bottom 242 may comprise one (1) or more drainage apertures 254 to drain rainwater and melted snow that may enter the drawer 240.

In some embodiments, the drawer 240 may comprise a pull handle 252 that may be adapted to be grasped by a user in order to open the drawer 240. In some embodiments, the drawer 240 may comprise a lock 260 that may be operable to prevent the drawer 240 from being opened unless the lock 260 is unlocked.

As non-limiting examples, the footstone 200 may be made of stone, metal, or any combination thereof. As non-limiting examples, the stone may be granite, marble, limestone, sandstone, or concrete and the metal may be bronze. As non-limiting examples, the drawer 240 may be made of composite resin or the same material as the footstone 200.

In use, the footstone 200 may be placed at the foot of the grave and the drawer 240 may be placed into the drawer aperture 212. The mementos may be placed into the drawer 240 in remembrance of the interred decedent. If necessary, the mementos may periodically be removed from the drawer 240 in order to make room for other mementos.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A memorial footstone comprising:

a base having a drawer aperture accessible from one side of the base, wherein the base comprises an inset surrounding the drawer aperture, the inset being an enlargement of the drawer aperture and shallower than the drawer aperture, such that a drawer front side of a drawer fits flush with the side of the base when the drawer is closed; and, a tablet positioned atop the base, the tablet comprising one or more faces with indicia conveying information about an interred decedent, wherein the tablet is located opposite a headstone; and, wherein the drawer being an open-top container is configured to slide into the drawer aperture and having a drainage aperture on a bottom surface to facilitate a removal of moisture, the drawer comprising a pull handle and a locking mechanism operable to secure the drawer within the drawer aperture and, wherein the tablet comprises a top with a decorative shape selected from an arched, gabled, sloped, irregular, or flat configuration, and the drawer is constructed from a composite resin material that resists corrosion and moisture damage when placed into the drawer aperture within the footstone base.

* * * * *